US005094622A

United States Patent [19]

Auclair

[11] Patent Number: 5,094,622

[45] Date of Patent: Mar. 10, 1992

[54] CABLE RACK BOND CLAMP

[75] Inventor: John W. Auclair, Canaan, Conn.

[73] Assignee: Electric Motion Company, Incorporated, Winsted, Conn.

[21] Appl. No.: 716,132

[22] Filed: Jun. 17, 1991

[51] Int. Cl.[5] ..... H01R 4/66

[52] U.S. Cl. ..... 439/92; 439/94

[58] Field of Search ..... 439/92, 94, 100, 431, 439/434, 435, 791, 794, 803, 815; 174/51

[56] References Cited

U.S. PATENT DOCUMENTS 1,936,982 11/1933 Koch ..... 439/431 X
2,250,280 7/1941 Starbird ..... 439/100 X
5,015,205 5/1991 Franks ..... 439/803

FOREIGN PATENT DOCUMENTS 3024632 2/1982 Fed. Rep. of Germany ..... 439/94

*Primary Examiner*—Eugene F. Desmond
*Attorney, Agent, or Firm*—Chilton, Alix & Van Kirk

[57] ABSTRACT

A bond clamp attaches to a T-slot of a cable rack for connecting a ground conductor. An L-shaped bolt inserted in a T-slot secures a pair of clamp members to the cable rack. The ground conductor is clamped between the clamp members to provide the electrical bond connection with the cable rack.

19 Claims, 2 Drawing Sheets

CABLE RACK BOND CLAMP

BACKGROUND OF THE INVENTION

This invention relates generally to cable racks which are used to support heavy cables and splice cases in manholes and controlled environmental vaults. More particularly, the present invention relates to various devices and techniques for bonding the cable racks to a common ground point.

Cable racks to which the invention relates are commonly installed in manholes and controlled environmental vaults. The cable racks conventionally are elongated metal members which have a row of generally T-shaped slots. The racks are vertically oriented and bolted to concrete walls by lag bolts or other conventional fastening means. Hooks for supporting heavy cables, splice cases and other products are removeably installed upon insertion in the cable rack slots.

The cable rack environment is frequently subject to ground water contamination as well as significant quantities of corrosive compounds. Salt and other corrosive chemicals are also found in the ground water. Consequently, the ground water functions as an electrolytic solution relative to the racks. If the metal hardware of the cable racking in the controlled environmental vaults or manholes is not at the same electrical potential, the electrolytic system accelerates corrosion of the cable racks.

The tendency of the metal cable racks to corrode as a result of their presence in an electrolytic system, has dictated the common practice of connecting the cable racks to a common ground point. While the conductor connection with a common ground point is accomplished in a wide variety of on-site expediently devised techniques, the most common technique is simply to clamp the ground conductor between a pair of washers secured to a lag bolt which mounts the cable rack.

SUMMARY OF THE INVENTION

Briefly stated, the invention in a preferred form is a ground clamp for bonding a ground conductor to a conductive cable rack of a type having a row of substantially T-shaped slots for removeably hanging cable support hooks. A clamp base plate has a pair of laterally spaced guide flanges and a pair of transversely spaced retainer flanges. The guide and retainer flanges project in generally opposing directions from the plate. A clamp plate is dimensioned to be received between the pair of retainer flanges. The clamp plate is seatable on the base plate. The base plate and the clamp plate have aligned apertures for receiving a clamp bolt. The clamp bolt has a hook portion and a threaded shank. A locking nut is threadable to the threaded shank and torqueable against the clamp plate. The hook and the base plate cooperate to engage opposed slot sides of the rack to clamp the base plate thereto, and the base plate and clamp plate clamp against a conductor which is disposed between the base plate and the clamp plate.

The clamp plate and/or the base plate have a plurality of indentation formed projections which bite into the conductor to facilitate the electrical connection with the conductor. The hook portion of the bolt may also have serrations at the inside of the hook to enhance the electrical and mechanical contact with the cable rack. In addition, indentation formed projections in the base plate enhance electrical and mechanical contact with the cable rack. The clamp is capable of accepting a wide variety of conductors such as, for example, plain bonding ribbon, perforated bonding ribbon, solid or stranded ground wire and braided conductors. More than one conductor may be connected by a given clamp.

An object of the invention is to provide a new and improved ground clamp for electrically bonding a ground conductor to a cable rack.

Another object of the invention is to provide a new and improved ground clamp specifically adapted for mounting to the cable rack to provide a ground connection of high integrity.

A further object of the invention is to provide a new and improved ground clamp for efficiently electrically bonding a wide variety of ground conductors to a cable rack.

Other objects and advantages of the invention will become apparent from the drawings and the specification.

DETAILED DESCRIPTION OF THE PREFERRED EMBODIMENT

Figure 1:
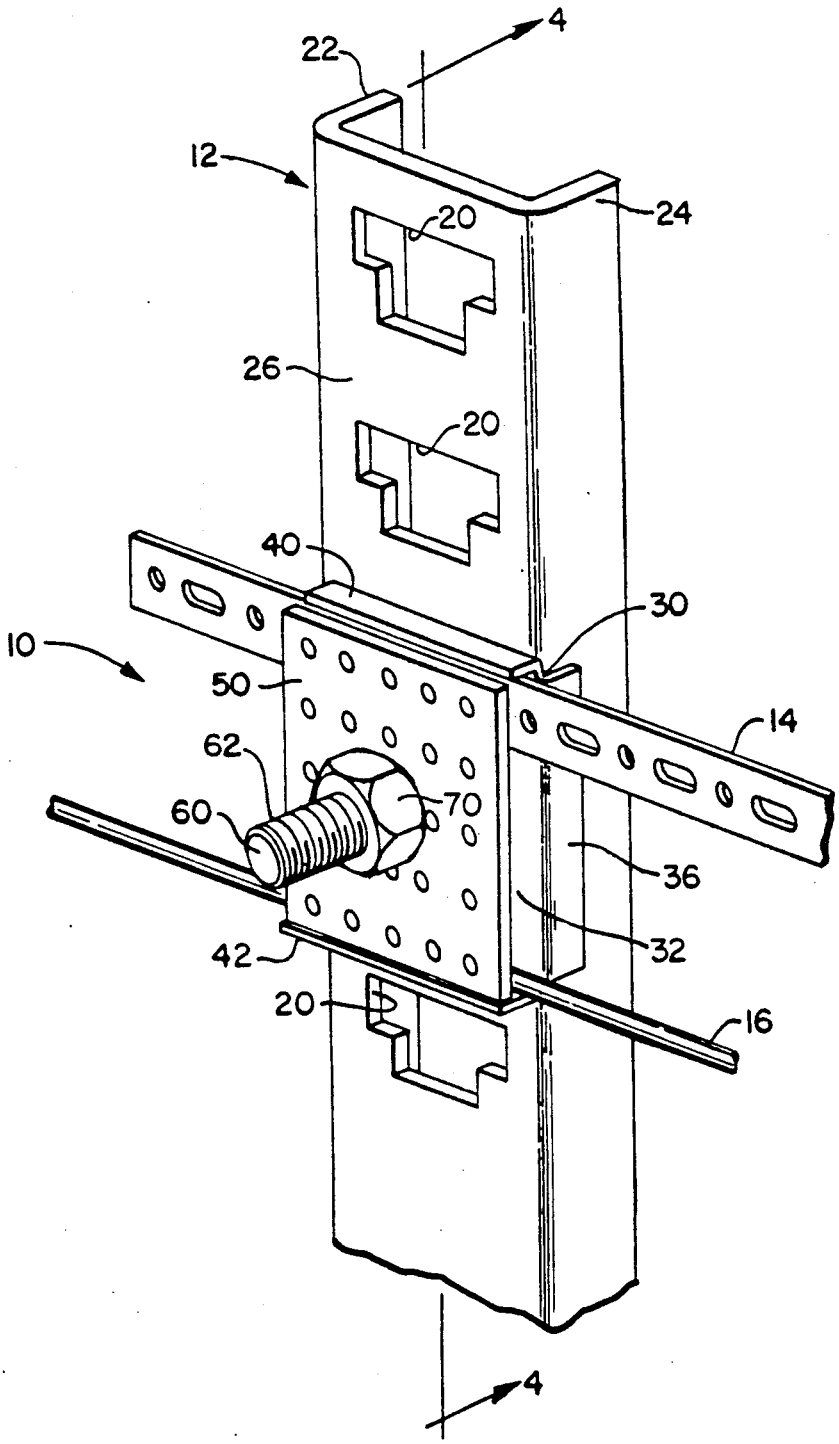
FIG. 1 is a frontal perspective view of a cable rack section and a ground clamp in accordance with the present invention, said ground clamp being mounted to the cable rack and being electrically bonded to a pair of conductors.

With reference to the drawings wherein like numerals represent like parts throughout the figures, a bond clamp in accordance with the present invention is generally designated by the numeral 10. The bond clamp is adapted for mounting on an electrically conductive cable rack (partially illustrated) designated generally by the numeral 12 for electrically connecting the cable rack to a ground point which is common with other cable racks. The bond clamp is suitable for connecting with a ribbon conductor 14, a No. 6 AWG ground wire 16, a braided conductor (not illustrated), a band conductor (not illustrated) and other conductors. The bond clamp is adapted to easily attach to the cable rack for establishing electrical connection with the ground conductor.

The cable rack 12 is a conventional standard cable rack which is installed in manholes, controlled environmental vaults and other similar environments for supporting various cables and other objects. Such cable racks are conventionally elongated metal supports which are sectional. Two or more rack sections can be bolted together to form one vertical rack unit which has a vertical series of aligned T-slots 20. The cable rack also typically includes a pair of opposed reinforced edges 22 and 24 which function to offset the face panel 26 of the rack from the wall. The cable rack 12 is mounted to the wall by means of lag bolts (not illustrated). Cable hooks (not illustrated) are removeably inserted into the T-slots 20 and are captured by the rear of the face plate 26 under the weight of the hooks and cables for supporting the cables. The principal function of the bond clamp 10 is to electrically bond the cable rack 12 with a ground conductor, for example, ribbon 14 and/or wire 16, so that all of the cable racks in a given environment may be connected to a common ground point. The grounded circuit inhibits corrosion of the racks due to ground water contaminated systems which are electrolytic in function.

The cable rack bond clamp 10 comprises a base 30 having a central, substantially square engagement plate 32. Opposing sides of the plate are bent perpendicularly to form a pair of guide flanges 34 and 36, which are equidistantly spaced so that the plate is slideable along the face 26 of the clamp rack, and the flanges 34 and 36 slidably engage the respective rack edges 22 and 24. A central square aperture 38 is punched into the base. The upper and lower portions of the base include a pair of equidistantly spaced forwardly projecting retainer flanges 40 and 42.

A substantially square retaining plate 50 is dimensioned for reception between said retaining flanges 40 and 42 and is appropriately congruent with the base engagement plate 32. The retaining plate includes a central opening 52. The plate 50 has an array of punched indentations which extend inwardly through the rear of the retainer plate to form projections 54. In the unclamped stated (FIGS. 2 and 3), the plate 50 may have a slightly convex-bowed configuration. The plate 50 assumes a generally planar configuration in the clamped state as described hereafter.

The base 30 and the retaining plate 50 are secured by a substantially L-shaped bolt 60. The bolt 60, when mounted, includes a forward shank having a threaded surface 62 and a rear hook portion 64 which is generally perpendicular to the shank. The rear of the shank has substantially square section which is a substantially commensurate with the square aperture 38 to angularly fix the bolt with the base 30. The rear interior surface of the bolt may have a plurality of serrations 66 which bite into the base at the rear of the face 26. The shank extends forwardly through the slot 20 and the apertures 38,52 and is secured to the base 30 and plate 50 by a locking nut 70. The base 30 may also have an array of punched projections 72 which are oriented to bite into the rack to enhance the electrical and mechanical connection therewith.

Figure 2:
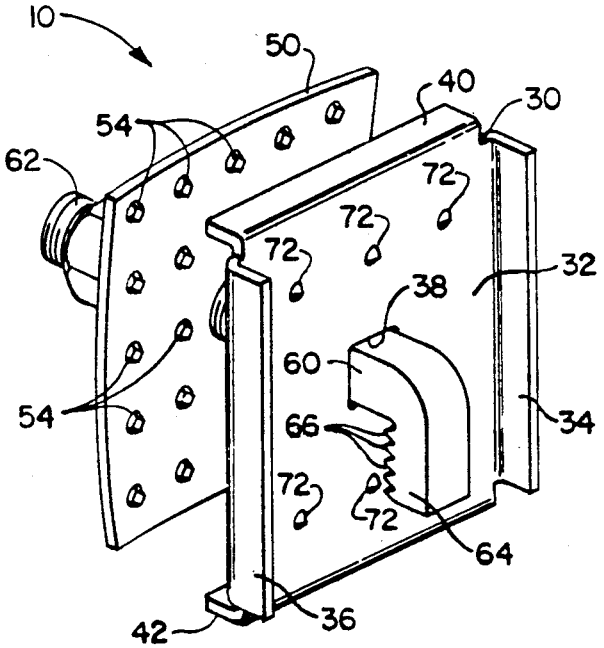
FIG. 2 is a rear perspective view of the ground clamp of FIG. 1.
Figure 3:
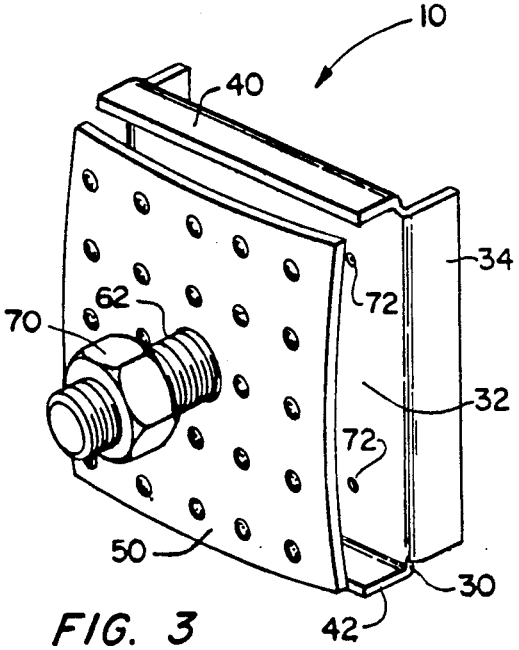
FIG. 3 is a frontal perspective view of the ground clamp of FIG. 1.
Figure 4:
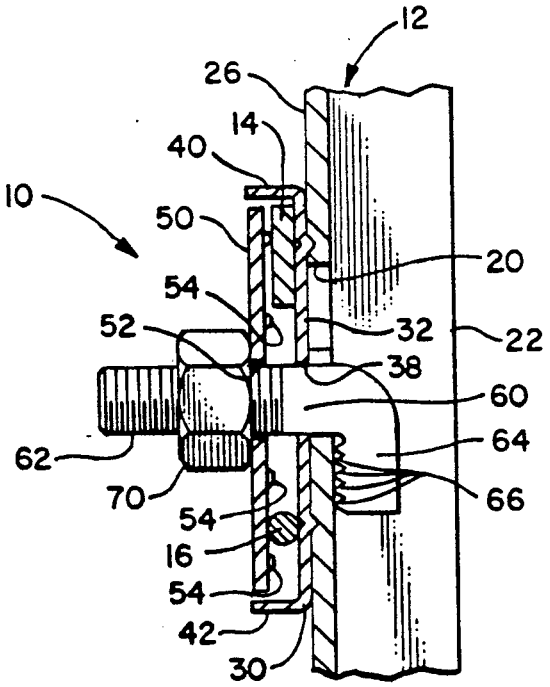
FIG. 4 is a sectional view of the rack and the ground clamp of FIG. 1, taken along the line 4—4 thereof.

The bond clamp 10 is assembled in a loose relationship, such as illustrated in FIGS. 2 and 3, with the bolt connecting the retainer plate 50 with the base 30 and being secured by the nut 70. The bond clamp is installed by hanging the clamp on the cable rack. The hook of the bolt is inserted through the T-slot 20 with the hook in a vertical downward orientation. The base plate/bolt assembly descends under the assembly weight to retain the clamp with the cable rack. The guide flanges cooperate to orient, retain and align the clamp with the cable rack.

One or more conductors are then inserted between the base plate and the retainer plate. The nut 70 is torqued to tighten the retainer plate against the conductors to thereby clamp the conductors in sandwiched relationship. The edges of the retainer plate 50 are engageable against the retaining flanges 40 and 42 to angularly fix the retainer plate and enhance the clamp engagement against the conductor. The torquing of the nut 70 forces the plate 50 into a substantially planar configuration to enhance the clamped engagement with the conductors. Torquing the nut also tightens the hook engagement of the bolt and locks the clamp with the cable rack.

It should be appreciated that an electrical bonding of high integrity is provided by the projections 54 biting into the conductors, by the serrations 66 biting into the cable rack at the rear of the cable rack, and by the projections of the base plate 72 biting into the rack. The components of the bond clamp are preferably steel members which are plated with zinc to enhance corrosion resistance. It should be appreciated that solid, strand, perforated, ribbon and braided conductors and other conductors may be connected and grounded as desired. The upper and lower retainer flanges 40 and 42 essentially fix the angular position of the retainer plate 50 and provide a means wherein the conductors are retained between the plates in the sandwiched relationship.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is

1. A ground clamp for bonding a ground conductor to a cable rack of a type having a row of slots for removeably mounting hooks comprising:

a base plate comprising a plate, a pair of laterally spaced guide flanges and a pair of transversely spaced retainer flanges, said guide and retainer flanges projecting in generally opposing directions from said plate and defining a first aperture;

a clamp plate dimensioned to be received between said pair of retainer flanges and seatable on said base plate and defining a second aperture;

a clamp bolt having a hook portion and a threaded shank, said shank being insertable through said first and second apertures; and a locking nut threadable to said threaded shank and torqueable to exert a force against said clamp plate so that said hook and base plate engage opposed slot sides of said rack to clamp said base plate thereto and a conductor disposed between said base plate and clamp plate is clamped therebetween.

2. The ground clamp of claim 1 wherein said clamp plate comprises a plurality of projections adapted to bite into a clamped conductor.

3. The ground clamp of claim 1 wherein said clamp bolt has a portion having a square section and said first aperture is substantially square.

4. The ground clamp of claim 1 wherein said hook portion comprises a plurality of serrations.

5. The ground clamp of claim 1 wherein said clamp plate is substantially square.

6. The ground clamp of claim 5 wherein said clamp plate has a slightly convex configuration in an unclamped state.

7. The ground clamp of claim 1 wherein said base plate further comprises a plurality of projections adapted to bite into said rack.

8. A ground assembly comprising:

a cable rack having an elongated support member, a pair of generally equidistantly spaced edges, and slot means for defining a row of slots in said support member;

a base plate having a pair of laterally spaced guide flanges engageable against said edges, said base plate engaging against said clamp rack support member and defining a generally central aperture, said base plate having a pair of retainer flanges which project generally transversely from said clamp rack;

a clamp bolt having a hook portion engaging the rear of said clamp rack support member and extending through a lower portion of a slot, said bolt projecting generally transversely to said cable rack and being received in said first aperture;

a clamp plate dimensioned to be received between a pair of retainer flanges and seatable on said base plate and defining a second aperture which receives said clamp bolt;

a conductor disposed between said base plate and said clamp plate in sandwiched clamp relationship thereto; and a locking nut threaded to said bolt shank to secure said base plate and clamp plate in clamped relationship with said conductor and attached relationship to said cable rack.

9. The assembly of claim 8 wherein said clamp plate further comprises a plurality of projections which bite into said conductor.

10. The assembly of claim 8 wherein said bolt further comprises a plurality of serrations which bite into said cable rack.

11. The assembly of claim 8 wherein said bolt has a generally L-shape.

12. The assembly of claim 8 wherein said base plate has a plurality of projections which bite into said clamp rack support member.

13. A ground clamp for bonding a ground conductor to a cable rack of a type having a row of slots for removeably mounting hooks comprising:

base means comprising a plate, a pair of laterally spaced guide flanges and a pair of traversely spaced retainer flanges, said guide and retainer flanges projecting in generally opposing directions from said plate, said plate defining a first aperture;

clamp means dimensioned to be received between said pair of retainer flanges and seatable on said base plate and defining a second aperture;

clamp bolt means having a hook portion and a threaded shank generally perpendicular to said hook portion, said shank being insertable through said first and second apertures and a said slot; and lock means threadable to said threaded shank and torqueable to exert a force against said clamp means so that said hook portion and said base plate engage opposed sides of said rack to clamp said base plate thereto and a conductor disposed between said base plate and clamp means is clamped therebetween.

14. The ground clamp of claim 13 wherein said clamp means comprises a plate which has a plurality of projections adapted to bite into a clamped conductor.

15. The ground clamp of claim 13 wherein said clamp bolt has a portion having a square section and said first aperture is substantially square.

16. The ground clamp of claim 13 wherein said hook portion comprises a plurality of serrations.

17. The ground clamp of claim 13 wherein said base plate means further comprises a plurality of integral projections which project in generally the same direction as the guide flanges.

18. The ground clamp of claim 13 wherein said clamp means comprises a plate having a slightly convex configuration when said clamp means is in an unclamped state.

19. The ground clamp of claim 18 wherein said clamp means plate is transformable to a substantially planar configuration when said conductor is clamped between said base plate and said clamp means.

* * * * *